United States Patent [19]

Yamamoto et al.

[11] Patent Number: 4,959,943

[45] Date of Patent: Oct. 2, 1990

[54] CAPSULE CHARGING APPARATUS

[75] Inventors: Taizo Yamamoto, Osaka; Masakiyo Inoue, Nara, both of Japan

[73] Assignee: Nippon Elanco Kabushiki Kaisha, Osaka, Japan

[21] Appl. No.: 321,984

[22] Filed: Mar. 10, 1989

[30] Foreign Application Priority Data

Mar. 11, 1988 [JP] Japan ..... 63-59107

[51] Int. Cl.[5] ..... B65B 1/04; B65B 7/28

[52] U.S. Cl. ..... 53/282; 53/900

[58] Field of Search ..... 53/282, 900, 381 A, 53/276, 281, 249

[56] References Cited

U.S. PATENT DOCUMENTS

| | | | |
|---|---|---|---|
| 3,070,932 | 1/1963 | Höfliger | 53/900 X |
| 3,078,629 | 2/1963 | Besemer et al. | 53/282 X |
| 3,527,015 | 9/1970 | Aronson et al. | 53/282 X |
| 3,534,526 | 10/1970 | Hostetler et al. | 53/282 |
| 3,538,677 | 11/1970 | Amoroso et al. | 53/282 X |
| 3,601,954 | 8/1971 | Aronson | 53/282 X |
| 4,091,600 | 5/1978 | Ithoh | 53/900 X |
| 4,731,979 | 3/1988 | Yamamoto et al. | 53/282 X |

FOREIGN PATENT DOCUMENTS 61-213050 9/1986 Japan .

*Primary Examiner*—Horace M. Culver

*Attorney, Agent, or Firm*—Irell & Manella

[57] ABSTRACT

A capsule charging apparatus that is a capsule conveying device disposed on a stand internally provided with at least one driving unit and a capsule charging device including at least one charging unit disposed on a stand which is detachably attached to the side of the stand of said capsule conveying device, said capsule conveying device arranging a plurality of capsules in which body portion are fitted into cap portions substantially vertically with their cap portions uppermost and their body portions below the cap portions; separating the capsules into the cap portions and the body portions; moving the separated cap portions and body portions in the horizontal direction; and fitting together the body portions and the cap portions again and said charging unit being driven by the driving unit inside the stand of said capsule conveying device.

5 Claims, 11 Drawing Sheets

CAPSULE CHARGING APPARATUS

BACKGROUND OF THE INVENTION

1. FIELD OF THE INVENTION:

This invention relates to a capsule charging apparatus for charging capsules with powdery, granular, or liquid pharmaceutics and foodstuffs.

2. DESCRIPTION OF THE PRIOR ART:

Powdery, granular, or liquid pharmaceutics have been stuffed into capsules made of gelatins so that they can be swallowed with ease when patients take these pharmaceutics. A capsule made of hard gelatins has a hollow body portion and a hollow cap portion. The diameter of the cap portion is somewhat greater than that of the body portion, and the open end of the body portion is fitted into the open end of the cap portion. Before being charged with some pharmaceutics, the capsule is supplied in the "unlocked" state in which the body portion is fitted into the cap portion only loosely. When the capsule is charged with a certain filling, the unlocked body and cap portions must be separated from each other in advance, and after the charging of the body portion with the filling is completed, the body and cap portions which have been separated from each other must be fitted together again.

In order to automate these series of processes, the applicants of the invention have developed the capsule charging apparatus which is disclosed in U.S. Pat. No. 4,731,979.

This capsule charging apparatus has a capsule moving unit. The capsule moving unit, after being supplied with a plurality of arranged capsules with their body portions facing downward, separates the capsules into the body and cap portions and then fits them together again, while conveying the capsules. The capsule moving unit is disposed on and fixed to a stand that is internally provided with a driving unit, and a charging unit for charging the body portion with a certain filling while the body portion is being conveyed by the capsule charging unit is also disposed on and fixed to the stand.

In recent years, granular and oily fillings of pharmaceutics in addition to powdery ones have been used as a filling of the capsules. Normally, a conventional capsule charging apparatus can charge the capsules only with a certain form of fillings. Therefore, when the fillings with different forms are stuffed into the capsules, it is necessary to detach the whole charging device from the stand and then attach to the stand another charging device with which a desired form of fillings can be stuffed into the capsules. The conventional capsule charging apparatus is disadvantageous in that, although the charging devices should be positioned in such a manner that the outlet openings for charging face the body portions being conveyed by the capsule moving unit accurately, it is difficult to achieve the accurate positioning of the charging devices, so the replacement of the charging devices takes long time.

SUMMARY OF THE INVENTION

The capsule charging apparatus of the invention, which overcomes the above-discussed and numerous other disadvantages and deficiencies of the prior art, comprises a capsule conveying device disposed on a stand internally provided with a driving unit and a capsule charging device including a charging unit disposed on a stand which is detachably attached to the side of the stand of said capsule conveying device, said capsule conveying device arranging a plurality of capsules in which body portion are fitted into cap portions substantially vertically with their cap portions uppermost and their body portions below the cap portions; separating the capsules into the cap portions and the body portions; moving the separated cap portions and body portions in the horizontal direction; and fitting together the body portions and the cap portions again and said charging unit being driven by the driving unit inside the stand of said capsule conveying device.

In a preferred embodiment, said capsule conveying device comprises a capsule moving unit including a cap supporting circle which is intermittently rotated to convey the cap portions separated from the body portions in groups consisting of a fixed number of cap portions and body supporters which respectively convey a fixed number of body portions separated from the cap portions while being intermittently rotated with said cap supporting circle.

In a preferred embodiment, said capsule conveying device comprises capsule arranging unit which supplies said capsule moving unit with a fixed number of capsules in a predetermined arrangement.

In a preferred embodiment, said capsule conveying device comprises a capsule transferring separating unit which separates the capsules arranged by said capsule arranging unit into the cap portions and the body portions while transferring the capsules to said capsule moving unit.

In a preferred embodiment, said charging unit of said capsule charging device can charge the body portions of the capsules with a filling of powder, granule, or liquid.

Thus, the invention described herein makes possible the objectives of (1) providing a capsule charging apparatus in which a capsule charging device for charging capsules with a certain form of filling can be easily attached to and detached from a capsule conveying device for conveying the capsules in the horizontal direction; (2) providing a capsule charging apparatus in which a capsule charging device for charging capsules with a certain form of filling can be easily replaced by another capsule charging device for charging the capsules with another form of filling; and (3) providing a capsule charging apparatus in which a capsule charging device having a driving unit in common with a capsule conveying device can be readily installed in synchronism with the capsule conveying device.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
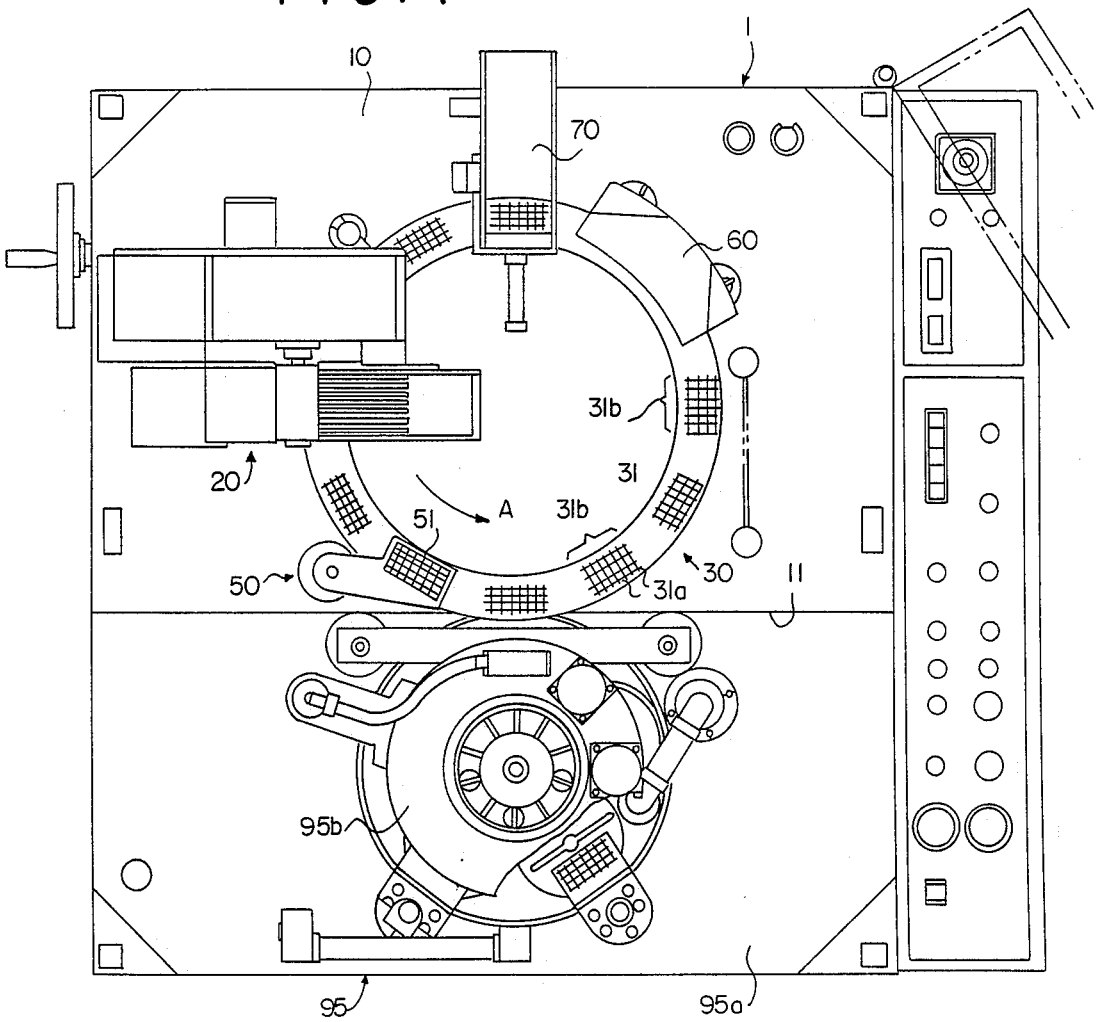
FIG. 1 is a plane view of a capsule charging apparatus of the invention.
Figure 2:
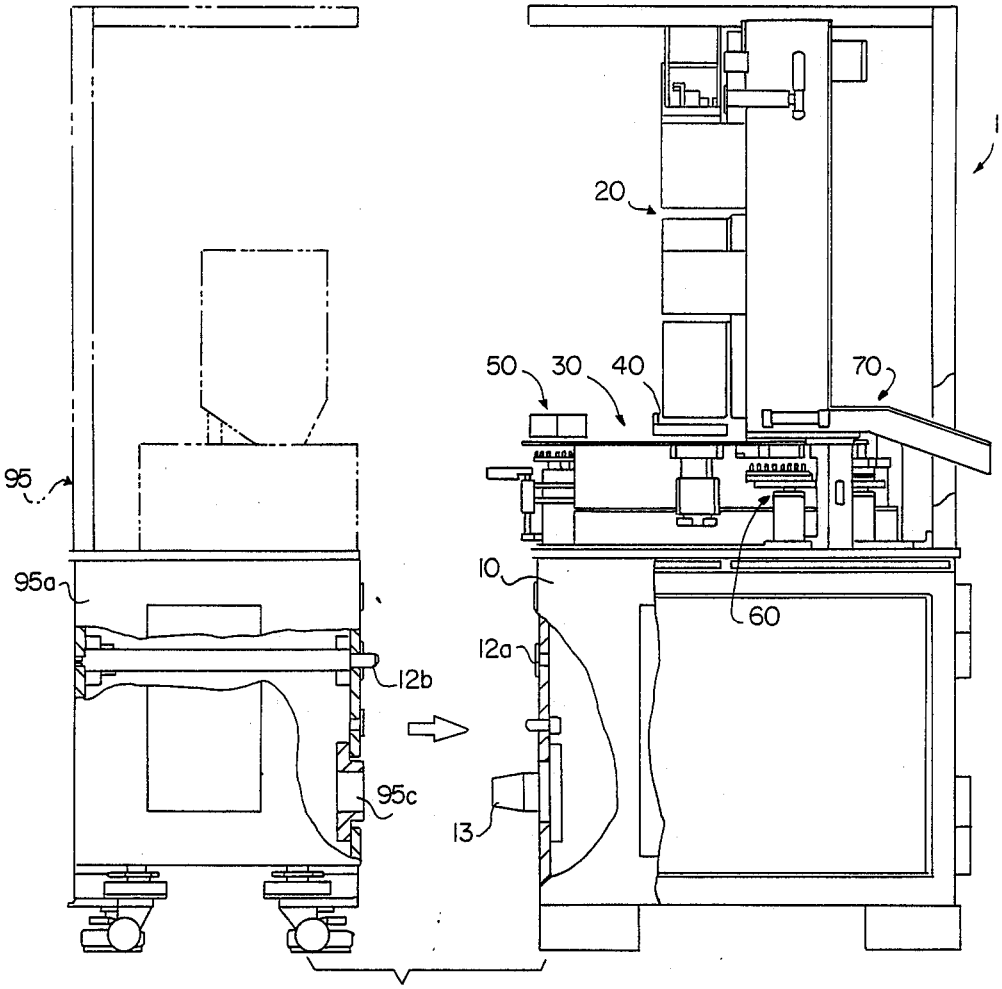
FIG. 2 is a front elevation of a capsule conveying device and a capsule charging device of the capsule charging apparatus of FIG. 1, which are separated from each other.
Figure 3:
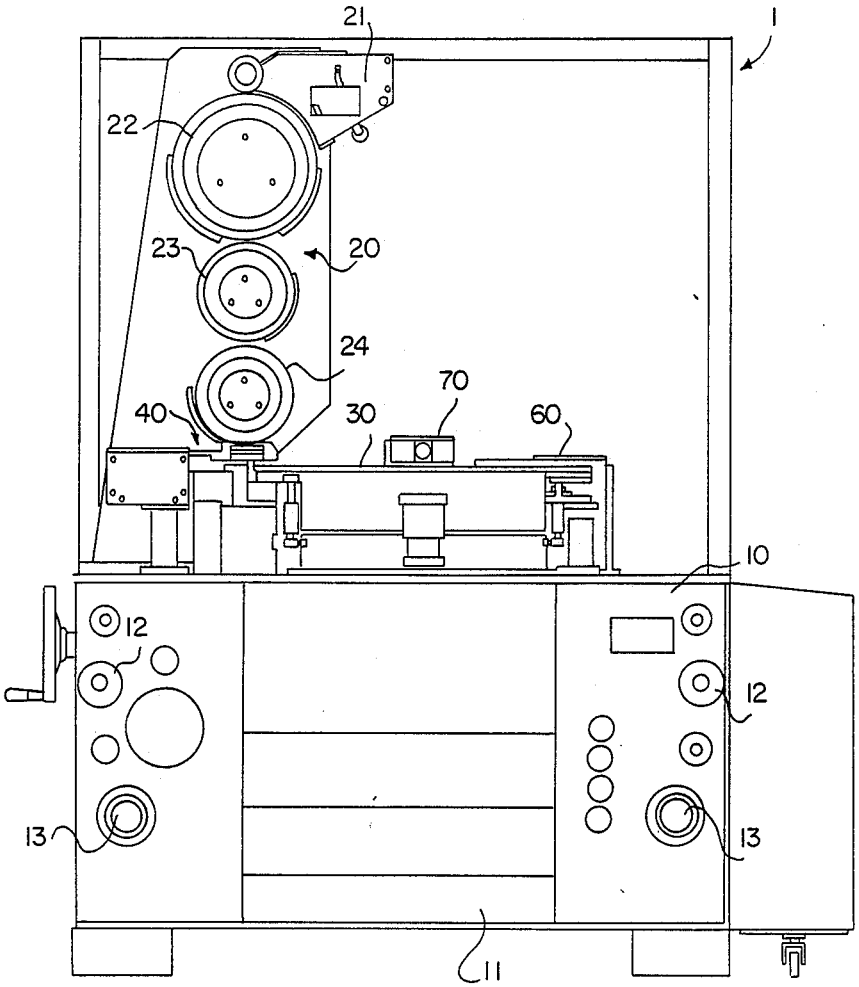
FIG. 3 is a side view of the capsule conveying device of FIG. 2.

As shown in FIGS. 1–3, the capsule charging apparatus of the invention comprises a capsule conveying device 1 including a capsule moving unit 30 and a capsule charging device 95. The capsule moving unit 30 of the capsule conveying device 1 is disposed on and fixed to a stand 10 and moves a plurality of capsules in a given circle in the direction indicated by an arrow A in the FIG. 1. During the conveyance, the capsules are in the unlocked state in which body portions are only loosely fitted into cap portions and arranged substantially vertically with their body portions facing downward. The capsule charging device 95 is connected to the capsule conveying device 1 and charges the capsules being conveyed with a filling. A driving unit for driving the capsule moving unit 30 is disposed inside the stand 10.

The capsule charging device 95 is detachably attached to the side of the stand 10 on which the capsule conveying device 1 is disposed. The capsule charging device 95 has a stand 95*a* of the same height as the stand 10 of the capsule conveying device 1. On the stand 95*a*, there is disposed a charging unit 95*b* for charging the body portions of the capsules with a filling of powder or other forms.

FIG. 2 is a front elevation of a capsule conveying device 1 and a capsule charging device 95, which are separated from each other. A pair of position regulating units 13 for regulating the position of the capsule charging device 95 are projected from the side of the stand 10. When the capsule charging device 95 is attached to the stand 10, the position regulating units 13 are fitted into concave portions 95*c* formed on the side of the stand 95*a* of the capsule charging device 95, so that the position of the capsule charging device with respect to the capsule conveying device 1 is regulated. There is also provided one part 12*a* of a coupling shaft on the side of the stand 10, and the other part 12*b* of the coupling shaft that is to engage with the part 12*a* of the coupling shaft is provided on the side of the stand 95*a* of the capsule charging device 95. When the position of the capsule charging device 95 with respect to the capsule conveying device 1 is regulated, the one part 12*a* of the coupling shaft on the side of the capsule conveying device 1 is connected to the other part 12*b* of the coupling shaft on the side of the capsule charging device 95, and the power by the driving unit disposed inside the stand 10 of the capsule conveying device 1 is transmitted to the capsule charging device 95, so that the charging unit 95*b* of the capsule charging device 95 is also driven by the driving unit of the capsule conveying device 1.

The capsule conveying device 1 has a capsule arranging unit 20 for arranging the unlocked capsules with their body portions facing downward. The capsules arranged by the capsule arranging unit 20 are transferred to the capsule moving unit and separated into the body and cap portions by a capsule transferring separating unit 40. While the capsules are being moved in a given circle in the direction shown by the arrow A of FIG. 1 by the capsule moving unit 30, the capsules which are not separated into the body and cap portions are removed, and the body portions of the remaining capsules are charged with a certain filling by the charging unit 95*b* of the above-mentioned charging device 95. The body portions, after being charged with the filling, are capped again with the cap portions by a capping unit 60, so as to be ejected from the capsule moving unit 30 by a capsule ejecting unit 70.

As shown in FIG. 1, the capsule moving unit 30 of the capsule conveying device 1 is provided with a cap supporting circle. As shown in FIG. 3, the capsule arranging unit 20 is positioned above the cap supporting circle or turret 31. The capsule arranging unit 20 consists of a contrarotating roller 24, a regulating roller 23, and a supply drum 22, which are vertically aligned from bottom to top in this order. A capsule hopper 21 is positioned so as to face the upper curved area of the supply drum 22.

Figure 4:
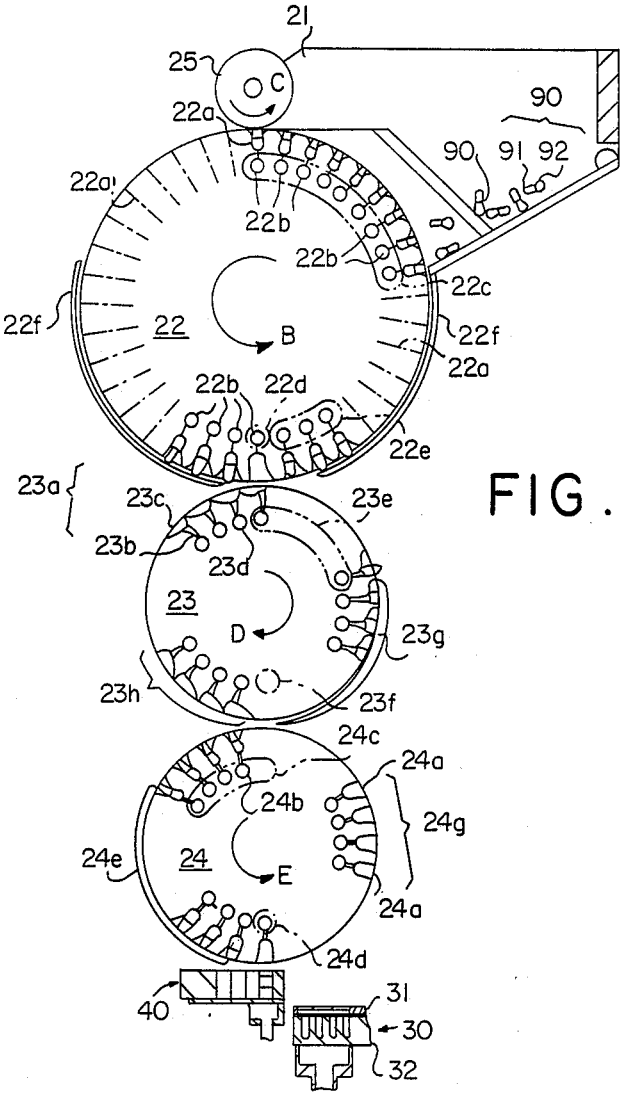
FIG. 4 is a view illustrating a capsule arranging unit of the capsule charging apparatus of the invention.

In FIG. 4, a plurality of unlocked capsules are seen inside the capsule hopper 21. The diameter of the cap portions is slightly greater than that of the body portions, and the open ends of the body portions are loosely fitted into the open ends of the cap portions.

The supply drum 22 can be rotated in the direction indicated by an arrow B shown in FIG. 4, and its curved area is formed with a plurality of capsule containing pockets 22*a* extending in the radial direction. These capsule containing pockets 22*a* are regularly spaced both in the long direction and in the direction along the outside circumference of the supply drum 22. In this example, a group consisting of 7 capsule containing pockets 22*a* is provided in the long direction of the supply drum 22, and a group consisting of 36 capsule containing pockets 22*a* is provided in the direction along the outside circumference of the supply drum 22. The diameter of the capsule containing pocket 22*a* is sufficiently greater than that of the cap portion 92 of the capsule 90 for the unlocked capsules 90 to be contained in the capsule containing pockets 22*a*. The capsule hopper 21, which is positioned upstream of the top portion of the supply drum 22 in the direction of rotation, successively supplies the capsule containing pockets 22*a* with the capsules 90 from the capsule hopper 21.

The capsule containing pocket 22*a* expands toward its opening on the surface of the curved area of the capsule supply drum 22, so that the capsule 90 from the capsule hopper 21 can not fail to be inserted into the capsule containing pocket 22*a*.

A rotatable brush roller 25 is provided above the capsule supply drum 22 to face the top portion of the capsule supply drum 22. The brush roller 25 is positioned so that its axis is in parallel with the axis of the capsule supply drum 22, and it can rotate in the same direction that the capsule supply drum 22 rotates as indicated by an arrow C of FIG. 4. The brush roller 25 ensures the insertion of the capsules 90 into the capsule containing pockets 22a by pushing against them.

Because the inner diameter of the capsule containing pocket 22a is greater than the outer diameter of the cap portion 92 of the capsule 90, capsules 90 from the capsule hopper 21 can be put into the capsule containing pockets 22a either body portion first or cap portion first.

The capsule containing pockets 22a aligned in the direction of the length of the capsule supply drum 22 are connected at their bottoms to an air passage 22b extending in the direction of the length of the capsule supply drum 22. The upper portion of one end of the capsule supply drum 22 is formed with a suction hole 22c. The suction hole 22c is connected to the air passages 22b positioned between the outlet of the capsule hopper 21 and the top portion of the capsule supply drum 22 and the air inside the capsule containing pockets 22a is sucked from the suction hole 22c through the air passages 22b, so that the capsules 90 from the capsule hopper 21 will not drop from the capsule containing pockets 22a while being conveyed to the top position of the capsule supply drum 22.

The suction hole 22c is connected to a proper sucking device, which depressurizes the capsule containing pockets 22a via the air passages 22b extending from the suction hole 22c to the capsule containing pockets 22a. Thus, the capsule 90 being inserted into the capsule containing pockets 22a is securely held in the capsule containing pockets 22a.

The air passage 22b which is connected to the capsule containing pockets 22a in the lowest position of the supply drum 22 leads to an air hole 22d formed on one end of the capsule supply drum 22. A gas such as compressed air is blown from the air hole 22d through the air passage 22b into the capsule containing pockets 22a in the lowest position of the supply drum 22, so as to eject the capsules 90 from the capsule containing pockets 22a.

The three preceding air passages 22b which are downstream in the direction of rotation of the supply drum 22 leading to the capsule containing pockets 22a in the lowest position are connected to the suction hole 22e formed on one end of the capsule supply drum 20. The suction hole 22e is connected to a proper sucking device, which depressurizes the capsule containing pockets 22a via the air passages 22b extending from the suction hole 22e to the capsule containing pockets 22a, so that the untransferred capsules 90 inserted into the capsule containing pockets 22a are securely held in the capsule containing pockets 22a without dropping from the capsule containing pockets 22a.

The lower part of the curved area of the capsule supply drum 22 other than its lowest position and its immediately downstream portion in the direction of rotation of the supply drum 22 is covered with a pair of plates 22f for preventing the capsules 90 from dropping from the capsule containing pockets 22a.

A regulating roller 23 is positioned immediately below the capsule supply drum 22. The regulating roller 23 rotates in the reverse direction (indicated by an arrow D of the FIG. 4) from that in which the capsule containing drum 22 rotates. The curved area of the regulating roller 23 is formed with a plurality of capsule containing pockets 23a, which constitute three groups 23h. These three groups 23h of capsule containing pockets 23a are regularly spaced. Each group 23h is of 28 capsule containing pockets 23a and there are 7 in the direction of the length of the roller 23 and 4 in the direction along the outside circumference of the roller 23. In both directions, there is a fixed interval between the capsule containing pockets 23a, which is equal to the interval between the capsule containing pockets 22a formed on the curved area of the capsule supply drum 22 mentioned above. The length of the space between neighboring groups 23h of capsule containing pockets 23a is equal to the length of the arc occupied by a single group 23h of capsule containing pockets 23a. The rotation speeds of the regulating roller 23 and the capsule supply drum 22 are set so that the capsules 90 contained in the capsule containing pockets 22a of the capsule supply drum 22 face the space between the groups 23h of capsule containing pockets 23a of the regulating roller 23 are not transferred to the regulating roller 23 when being conveyed to the lowest position of the capsule supply drum 2 for the first time, and that the capsules 90 contained in the capsule containing pockets 22a of the capsule supply drum 22 face the capsule containing pockets 23a of the regulating roller 23 and are transferred tot he regulating roller 23 when being conveyed to the lowest position of the capsule supply drum 22 after the drum 22 makes one revolution. In this way, the number of the capsule containing pockets 23a which do not contain the capsules 90 can be minimized.

Each capsule containing pocket 23a of the regulating roller 23 consists of a body supporting element 23b and a capsule containing element 23c. The body supporting element 23b extends in the radial direction and the capsule containing element 23c which is connected to the body supporting element 23b extends in the direction along the outside circumference of the regulating roller 23 so as to contain the capsule 90 in a recumbent position. The inner diameter of the body supporting element 23b is greater than that of the outer diameter of the body portion 91 of the capsule 90 but is smaller than that of the outside diameter of the cap portion 92 of the capsule 90. Accordingly, when the capsule 90 is inserted body portion 91 first through the capsule containing element 23c into the body supporting element 23b, the body portion 91 of the capsule 90 is supported by the body supporting element 23b with the cap portion 92 situated in the capsule containing element 23c, so that the whole capsule 90 is held vertically in the capsule containing pocket 23a of the regulating roller. In this case, the tip of the cap portion 92 does not substantially protrude from the curved area of the regulating roller 22 or protrudes only to a small extent. By contrast, when the capsule 90 is inserted cap portion 92 first into the capsule containing element 23c to the body supporting element 23b, the cap portion 92 is not supported by the body supporting element 23b but is held by the capsule containing element 23c, so that the capsule 90 is held with its body portion radially protruding from the curved area of the regulating roller 23.

The capsule containing element 23c for receiving the capsule 90 in the recumbent position extends from the outer end of the body supporting element 23b in the direction opposite to the rotation of the regulating roller 23 along the outside circumference of the regulating roller 23.

The body supporting elements 23b of the capsule containing pockets 23a aligned in the long direction of the regulating roller 23 are connected at their bottoms to air passages 23d extending in the long direction of the regulating roller 23. The upper part of one end of the regulating roller 23 is formed with a air hole 23e. The air hole 23e extends from the top portion of the regulating roller 23 downstream in the direction of rotation of the regulating roller 23 to form an arc and is connected to the air passages 23d in the corresponding position. The air hole 23e is connected to a suitable sucking device which depressurizes the capsule containing pockets 23a via the air passage 23d.

One end of the regulating roller 23 is formed with an air hole 23f containing to the air passage 23d which are connected to the capsule containing pockets 23a in the lowest position of the regulating roller 23. A gas such as compressed air is blown from the air hole 23f through the air passage 23d into the capsule containing pockets 23a connecting to the air hole 23f. The capsules 90 contained in the capsule containing pockets 23a are ejected from the capsule containing pockets 23a by the blowing of the gas.

A plate 23g for laying down the untransferred capsules 90 is positioned some distance away from the surface of the curved area of the regulating roller 23, which covers the part of curved area of the regulating roller 23 from the lowest position of the regulating roller 23 to the portion adjacent to the lower end of the air hole 23e. While the regulating roller 23 is rotating, any capsule 90 held in the capsule containing pocket 23a with its body portion 91 radially protruding from the curved area of the regulating roller 23 is brought into contact with and laid down by the plate 23g, so that the capsule 90 is recumbently contained in the capsule containing element 23c with its cap portion 92 facing the body supporting element 23a.

The upper end of the plate 23g which comes into contact with the capsule 90 with its body portion 91 protruding from the curved area of the regulating roller 23 corresponds to the lower end of the air hole 23e, so that the capsule 90, after being laid down by the upper end of the plate 23g, is sucked through the hole 23e and contained in the capsule containing pocket 23a.

The contrarotating drum 24 positioned below the regulating roller 23 has a diameter which is equal to that of the regulating roller 23, and is rotated in the reverse direction as indicated by an arrow E of FIG. 4 and at the same speed that the regulating roller 23 is rotated. The curved area of the contrarotating roller 24 is provided with three groups 24g of pockets which face the group 23h of pockets of the regulating roller 23 while the contrarotating roller 24 and the regulating roller 23 are being rotated. Each group 24g is of 28 capsule containing pockets 24a, which are arranged in 7 lines and 4 rows in the same way as the groups 24h of pockets of the regulating roller are arranged. The capsule containing pocket 24a extends in the radial direction and its opening on the surface of the curved area widens slightly. The capsule containing pockets 24a arranged in the long direction of the contrarotating roller 24 are connected at the bottom to air passages 24b extending in the along direction of the contrarotating rollers 24. One end of the contrarotating roller 24 is formed with and arc-shaped air hole 24c which extends from the top portion of the contrarotating roller 24 to the portion adjacent to the upper end of a plate 24e for preventing the capsules 90 from dropping and which is connected to the air passages 24b in the corresponding position. The curved area of the contrarotating roller 24 is covered from the portion corresponding to the lower end of the air hole 24c to the portion adjacent to the lowest position of the contrarotating roller 24 with a plate 24e for preventing the capsules from dropping.

The capsule containing pockets 24a aligned in the top portion of the contrarotating roller 24 which are connected to the air hole 24c via the air passage 24b are opposed to the capsule containing pockets 23a aligned in the lowest position of the regulating roller 23 positioned above the contrarotating roller 24. By depressurizing the capsule containing pockets 24a of the contrarotating roller 24 and blowing a gas into the capsule containing pockets 23a of the regulating roller 23 facing the capsule containing pockets 24a, the capsules 90 containing in the capsule containing pockets 23a are put into the capsule containing pockets 24a of the contrarotating roller 24. When the capsule 90 is contained in the capsule containing pocket 23a of the regulating roller 23 with its body portion 91 supported by the body supporting element 23b of the capsule containing pocket 23a, the capsule 90 is inserted into the capsule containing pocket 24a of the contrarotating roller 24 the cap portion 92 first. When the capsule 90 is in the recumbent position in the capsule containing element 23c of the capsule containing pocket 23a of the regulating roller 23, it is blown by a gas from the body supporting element 23b to make a 90° turn so that the cap portion 92 protrudes from inside the capsule containing pocket 23a, and is inserted into the capsule containing pocket 24a of the contrarotating roller 24 the cap portion 92 first.

The lower part of one end of the contrarotating roller 24 is formed with an air hole 24d, which is connected to the capsule containing pockets 24a aligned in the lowest position of the contrarotating roller 24 via the air passage 24b. A gas such as compressed air is blown from the air hole 24d through the air passage 24b into the capsule containing pockets 24a to eject the capsules 90 from the capsule containing pockets 24a. The capsules are then transferred by the capsule transferring separating unit 40 to the capsule moving unit 30 positioned below. The capsule moving unit 30 will be described below in detail.

Figure 5B:
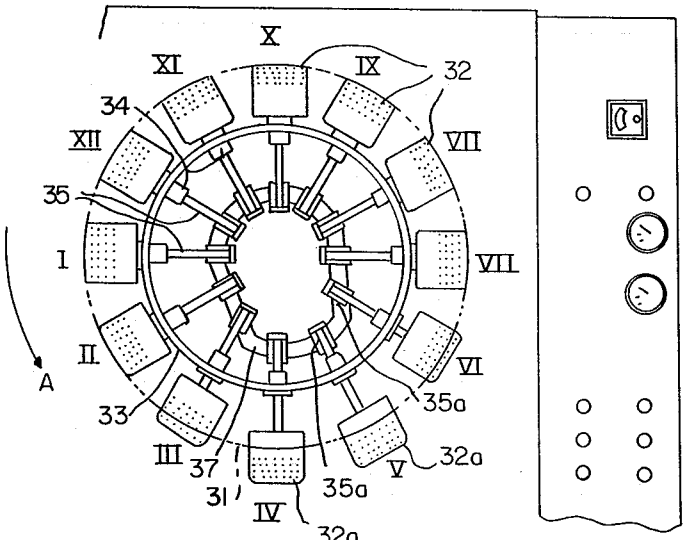
FIG. 5*b* is a plane view of the capsule moving unit of FIG. 5*a* without a cap supporting circle.
Figure 5A:
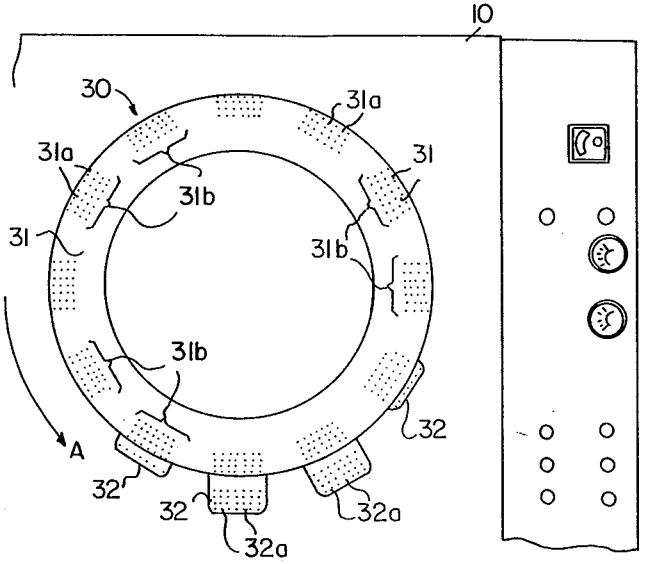
FIG. 5*a* is a plane view of the capsule moving unit of the capsule charging apparatus of the invention.
Figure 5C:
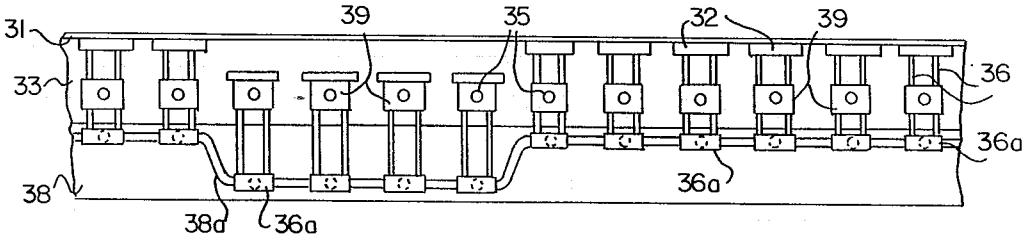
FIG. 5*c* is a developed view of the capsule moving unit of FIG. 5*a*.

As shown in FIGS. 5a to 5c, the capsule conveying unit 30 has a rotatable cap supporting circle 31 and twelve body supporters 82 which are radially positioned below the cap supporting circle 31.

The cap supporting circle 31 is positioned substantially horizontally, and its outer periphery is provided with twelve groups 31b of capsule containing pockets 31a. Each group 31b is of 28 capsule containing pockets 31a which are arranged in 7 lines and 4 rows. The capsule containing pockets 31a vertically pass through the cap supporting circle 31. The cap supporting circle 31 is positioned below the contrarotating roller 24 and at the side downstream of the lowest position in the direction of rotation of the contrarotating roller 24 (See FIGS. 6).

Figure 8:
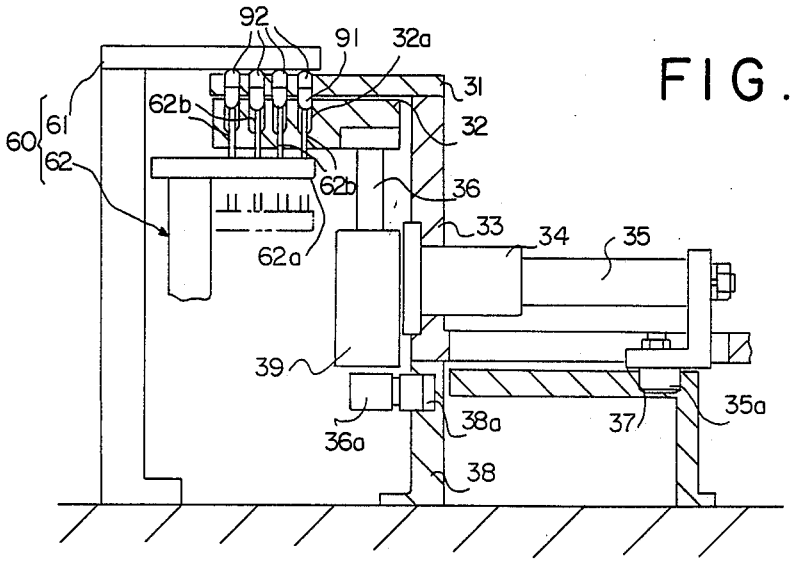
FIG. 8 is a cross sectional view of the capping unit of the capsule charging apparatus of the invention.

As shown in FIG. 8, the upper end of a supporting cylinder 33 is attached to the inner peripheral portion of the undersurface of the cap supporting circle 31. The lower end of the supporting cylinder 33 is rotatably attached to the upper end of the fixing cylinder 38 of the same diameter as the supporting cylinder 33, and the supporting cylinder 33 can be integrally rotated with the cap supporting circle 31. As shown in FIG. 5b, twelve cylindrical bushings 34 which horizontally penetrate the supporting cylinder 33 are attached to the supporting cylinder 33. One bushing 34 is correspondent to one group 31b of pockets of the cap supporting circle 31. Arms 35 slidably penetrate the bushings 34 one by one in the horizontal direction, and extend toward the axis of the supporting cylinder 33.

Figure 6A:
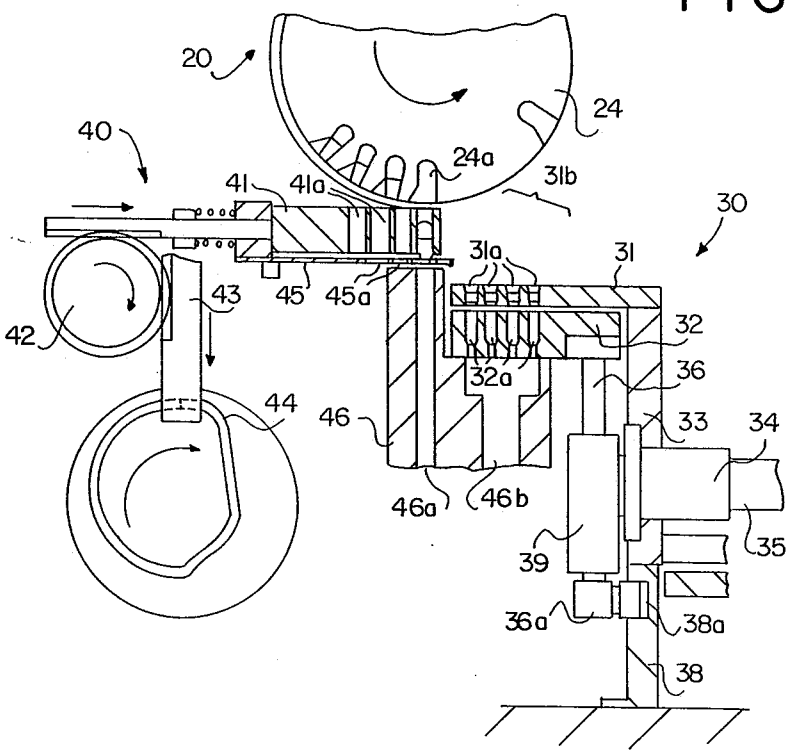
FIG. 6*a* is a cross-sectional view of a capsule transferring separating unit of the capsule charging apparatus of the invention.
Figure 6B:
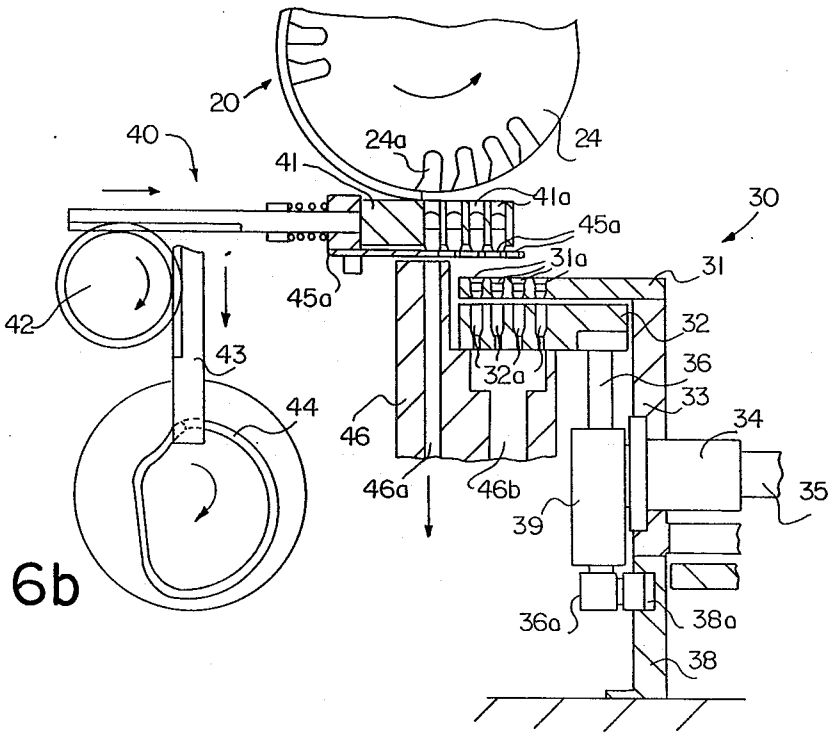
FIGS. 6*b* and 6*c* are views respectively illustrating the operation of the capsule transferring separating unit of FIG. 6*a*.
Figure 6C:
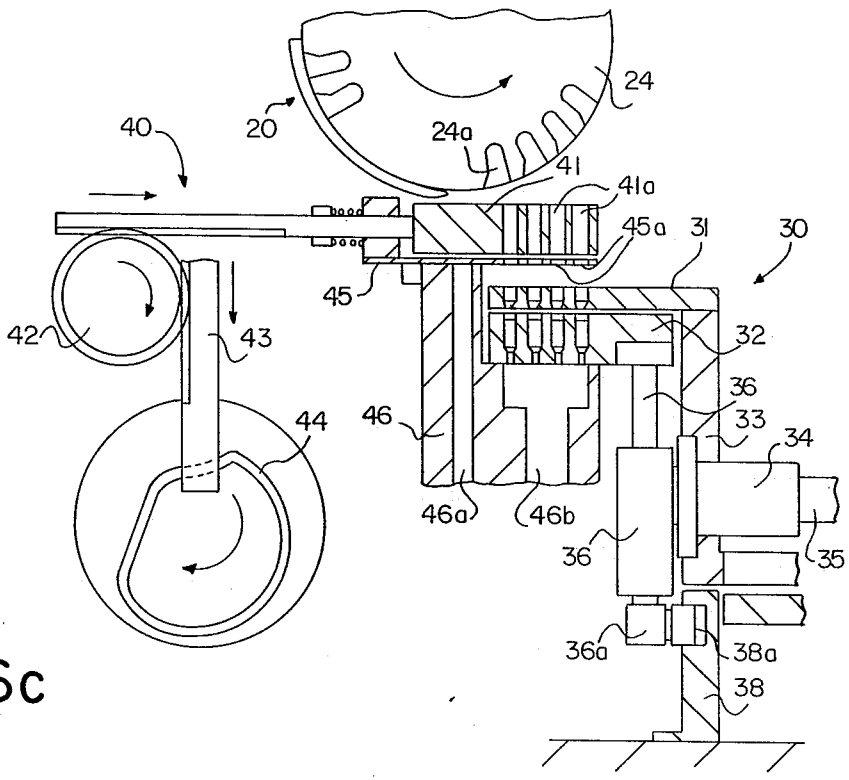
Figure 7:
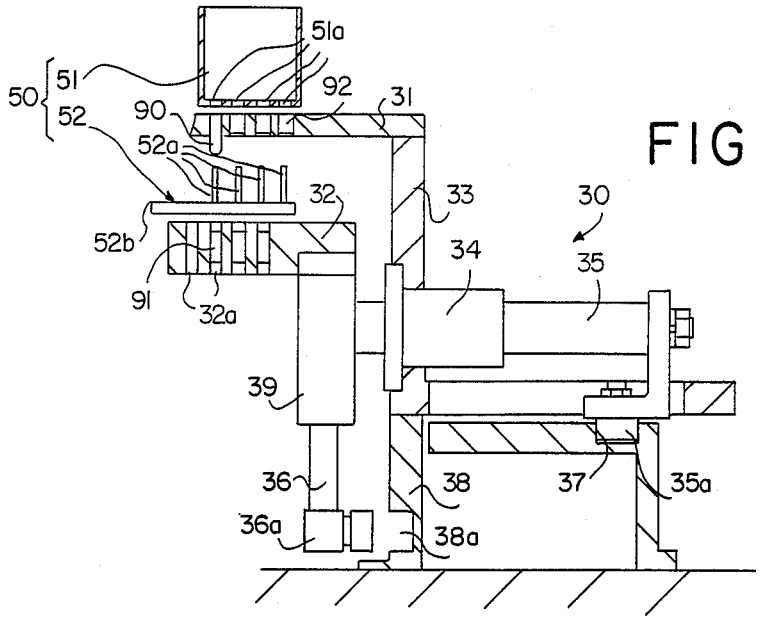
FIG. 7 is a cross sectional view of the unseparated capsule removing unit of the capsule charging apparatus of the invention.

FIG. 5c is a developed view of the supporting cylinder 33 and the fixing cylinder 38. As shown in FIG. 5c and FIGS. 6, connectors 39 are attached to the tips of the arms 35 one by one which are protruding outward from the supporting cylinder 33 and supporting rods 36 are biased downward by a proper means. The connector 39 holds the supporting rods 36 substantially vertically. The upper ends of the pairs of supporting rods 36 are attached to the undersurface of body supporters 32 in the shape of a flat plate. The body supporter 32 is held in a substantially horizontal position, and has a plurality of body containing pockets 32a for containing the body portions 91 of the capsules 90. In each body supporter 32, there are 28 capsule body containing pockets 32a which are arranged for example in 7 lines and 4 rows and which vertically pass through the body supporter 32.

Sliders 36a are attached to the lower ends of the supporting rods 36. There is a guiding groove 38a formed on the curved area of the fixing cylinder 38, and the sliders 36a are slidably fitted in the guiding groove 38a so as to slide along the guiding groove 38a with the rotation of the supporting cylinder 33.

As described above, one end of the arm 35 is attached to the supporting cylinder 33 via the bushing 34 so that the arm 35 extends toward the axis of the supporting cylinder 38. The other end of the arm 35 is inside the circumference of the supporting cylinder 33, and cam followers 35a are attached to the ends of the arms 35 inside the circumference of the supporting cylinder 33. The cam followers 35a are slidably fitted in the guiding groove of the positive cam 37 with an aperture facing upward. As shown in FIG. 5b, the positive cam 37 shifts the arm 35 in the radial direction of the supporting cylinder 33 while the supporting cylinder 33 is being rotated in the direction indicated by the arrow A. The shift of the arm 35 caused by the positive cam 37 is as follows. In the position I shown in FIG. 5b in which the body supporter 32 at the end of the arm 35 is brought nearer to the contrarotating roller 24 and in the position II which is taken by the body supporter 32 after the supporting cylinder 33 is rotated by 30° from the position I, the arms 35 are drawn inside the supporting cylinder 33 so that the body supporters 32 do not jut out of the outer circumference of the cap supporting circle 31. In the position III which is taken by the body supporter 32 after the body cylinder 33 is rotated by 30° from the position II, the arm 35 is shifted in the radial direction so that the body supporter 32 juts out of the outer circumference of the cap supporting circle 31 to a small extent. In this case, since the supporting cylinder 33 is integrated with the cap supporting circle 31, the cap supporting circle 31 is rotated as the supporting cylinder 33 rotates. In the position IV which is taken by the body supporter 32 after the supporting cylinder 33 is rotated by 30° from the position III, the arm 35 is shifted in the radial direction so that the body supporter 32 juts out of the outer circumference of the cap supporting circle 31 and all the body containing pockets 32a on the body supporter 32 are outside of the outer circumference of the cap supporting circle 31. This configuration is maintained in position V which is taken by the body supporter 32 after the supporting cylinder 33 is rotated by 30° from the position IV. In position VI which is taken by the body supporter 32 after the supporting cylinder 33 is rotated by 30° from position V, the body supporter 32 is withdrawn beneath the cap supporting circle 31 once more so as no& to jut out. This configuration is maintained in the positions VII, VIII, IX, X, XI, XII, and I while the supporting cylinder 33 is being rotated 180°. When the body supporter 32 is inside the outer circumference of the cap supporting circle 31, the body containing pockets 32a of the body supporter 32 are opposed to the cap containing pockets 31a in the groups 31b of the cap supporting circle 31. With the rotation of the supporting cylinder 33, the cap supporting circle 31 and the body supporters 32 are integrally rotated with each other. As shown in FIG. 5b, the rotation of the cap supporting circle 31 and the body supporters 32 is performed intermittently, so that the body supporters 32 pause in each of the positions I to XIII shown in FIG. 5b.

When the arm 35 shifts outward of the supporting cylinder 33, the slider 36a which is attached to the end of the arm 35 via the connector 39 and supporting rods 36 comes off the guiding groove 38a of the fixing cylinder 38. As described above, the supporting rods 36 are biased downward with respect to the connector 39, so that the body supporter 32 as well as the supporting rods 36 are shifted downward. The guiding groove 38a is formed so that the slider 36a slides along the guiding groove 38a. Where the level of the slider 36a is lowered, the level of the guiding groove 38a is also lowered to guide the slider 36a.

As described above, the capsule transferring separating unit 40 is positioned below the contrarotating roller 24. As shown in FIG. 6a, the capsule transferring separating unit 40 has a palette 41 in the shape of a flat plate which is disposed substantially horizontally. The palette 41 is formed with holes 41a which vertically pass through the palette 41 and are arranged in 7 lines and 4 rows in the same way that the capsule containing pockets 24a in the groups 24g of the curved area of the contrarotating roller 24 are arranged. The capsules 90 are contained in the holes 41a in a substantially vertical position. The palette 41 which is positioned below the contrarotating roller 24 can be moved in the horizontal direction to a position over the groups 31b of cap containing pockets 31a of the cap supporting circle 31.

The horizontal movement of the palette 41 is caused by the rotation of a pinion gear 42. The pinion gear 42 meshes with a rack 43 and is connected to a cap 44 which rotates in synchronism with the rack 43 and the contrarotating roller 24. As shown in FIG. 6b, the palette 41 is intermittently moved in the horizontal direction so that the holes 41a face the capsule containing pockets 24a in the lowest position of the contrarotating roller 24 line by line in timing with the contrarotating roller 24. The palette 41 is then further moved to the position in which the holes 41a face the cap containing pockets 31a in groups 31b of the cap supporting circle 31.

A shutter 45 is positioned underneath the palette 41. The shutter 45 is formed with holes 45a which vertically pass through the shutter 45. The holes 45a are of the same diameter as the holes 41a of the palette 41, and can be opposed to the holes 41a. While the palette 41 is being moved so that the lines of holes 41a successively face the lines of capsule containing pockets 24a of the contrarotating roller 24, the shutter 45 is moved together with the palette 41 in such a manner that the lines of holes 45a do not face the lines of the holes 41a of the palette 41. When all the lines of holes 41a come to face the corresponding lines of capsule containing pockets 24a, the shutter 45 stops moving and only the palette 41 moves on in the vertical direction over the cap supporting circle 31 to the position in which the holes 41*a* are opposed to the holes 45*a* of the shutter 45.

The lowest position of the contrarotating roller 24 is opposed to the sucking hole 46*a* formed in the block 46 with the palette 41 and the shutter 45 interposed therebetween. When the line of holes 41*a* comes to face the line of capsule containing pockets 24*a* in the lowest position of the contrarotating roller 24, the sucking hole 46*a* attracts the capsules 90 from the capsule containing pocket 24*a* by sucking and transfers them into the hole 41*a* of the palette 41, where the capsules 90 remain due to the shutter 45.

The sucking hole 46*b* is formed in the block 46*b* to face a group 31*b* of cap supporting pockets 31*a* from underneath with the body supporter 32 interposed therebetween. The sucking hole 46*b* sucks the air through the holes 41*a* of the palette 41, the holes 45*a* of the shutter 45, the group 31*b* of cap supporting pockets 31*a* of the cap supporting circle 31, and the body containing pockets 32*a* of the body supporter 32, which are opposed to each other. The capsules 90 which are contained in the holes 41*a* of the palette 41 are transferred into the cap containing pockets 31*a* of the cap supporting circle 31 the body portion 91 first through the holes 45*a* of the shutter 45.

The inner diameter of the upper portion of the cap containing pocket 31*a* is slightly greater than the outer diameter of the cap portion 92, but the inner diameter of the lower portion of the cap containing pocket 31*a* is slightly smaller than the outer diameter of the cap portion 92 and slightly greater than the outer diameter of the body portion 91. The inner diameter of the upper portion of the body containing pocket 32*a* is slightly greater than the outer diameter of the body portion 91, but the inner diameter of the lower portion of the body containing pocket 32*a* is slightly smaller than the outer diameter of the body portion 91. Accordingly, only the cap portion 92 of the capsule 90 is held by the cap containing pocket 31*a* whereas the body portion 91, after being separated from the cap portion 92, is put into the body containing pocket 32*a* of the body supporter 32.

In position III shown in FIG. 5*b* 60° apart from the capsule transporting-separating unit 40 in the direction of rotation of the cap supporting circle 31, an unseparated capsule removing unit 50 is provided. In the position III, the body supporter 32 is seen below the cap supporting circle 31 at some distance away. The unseparated capsule removing unit 50 has a recovery case 51 and a recovering member 52 which is disposed between the cap supporting circle 31 and the body supporter 32. On the bottom face of the recovery case 51, oblong holes 51*a* are formed to face the cap containing pockets 31*a* in the group 31*b* of the cap supporting circle 31. The shorter diameter of the oblong holes 51*a* is slightly smaller than the outer diameter of the cap portion 92. The recovering member 52 has pins 52*a* which are inserted into the holes 51*a* formed on the bottom face of the recovery case 51. The pins 52*a* protrude substantially vertically from the top surface of the elevator 52*b* in the shape of a flat plate. The elevator 52*b* ascends and descends in a substantially horizontal position.

When the pins 52*a* of the recovering member 52 and the oblong holes 51*a* formed on the bottom face of the recovery case 51 are opposed to the cap containing pockets 31*a* in the group 31*b* of the cap supporting circle 31, the elevator 52*b* of the recovering member 52 ascends so that the pins 52*a* are inserted into the cap containing pockets 31*a* of the cap supporting circle 31. When the capsule 90 which is not separated into the body portion 91 and the cap portion 92 is present in the cap containing pocket 31*a* of the cap supporting circle 31, the capsule 90 is pushed up by the pin 52*a* with the ascending of the elevator 52*b* to pass through the oblong hole 51*a* of the recovery case 51 while being deformed and is recovered in the recovery case 51. Since the shorter diameter of the oblong hole 51*a* of the recovery case 51 is smaller than the outer diameter of the capsule 90, there is no danger that the capsule 90 drops through the oblong hole 51*a*. Although the pin 52*a* is inserted into the cap portion 92 with the ascending of the elevator 52*b*, the tip of the pin 52*a* does not reach the top of the cap portion 92, so that the ascending of the pin 52*a* does not cause the removal of the cap portion 92 from the cap supporting circle 31.

In position IV shown in FIG. 5*b* 30° apart from the unseparated capsule removing unit 50 in the direction of rotation of the cap supporting circle 31, the outlets of the charging unit 95*b* of the capsule charging apparatus 95 are positioned. In this position, the body containing pockets 32*a* of the body supporter 32 are seen outside of the outer circumference of the cap supporting circle 31 and the outlets of the charging unit 95*b* are opposed to the body portions 91 in the body supporting pockets 32*a* so that the body portions 91 are charged with a fixed amount of filling.

In position V shown in FIG. 5*b* 30° apart from position IV in the direction of rotation of the cap supporting circle 31, the body containing pockets 32*a* of the body supporter 32 are also seen outside of the outer circumference of the cap supporting circle 31, so that the body portions 91 are charged with a fixed amount of filling. Therefore, it is possible to charge the body portions 91 with two different fillings during one pass of the body portions 91.

After being charged with a certain filling in position IV, the body portions 91 supported by the body supporters 32 are conveyed to the position VIII 120° apart from position IV as shown in FIG. 5*b*, where the capping unit 60 is positioned. The capping unit 60 fits together the body portion 91 and the cap portion 92, which were separated from the each other by the capsule transferring separating unit 40. As shown in FIG. 8, the capping unit 60 comprises a cap depressing plate 61 and a pair of body lifting plates 62 (In FIG. 8, only one body lifting plate 62 is shown). The cap depressing plate 61 covers the groups 31*b* of pockets in the position VIII and in the adjacent position IX of the cap supporting circle 31 shown in FIG. 5*b*. The pair of body lifting plates 62 are seen under the body supporters 32 which face the groups 31*b* of pockets of the cap supporting circle 31, and have elevators 62*a* which are positioned substantially horizontally below the body supporters 32 and a plurality of pins 62*b* which protrude from the top surface of the elevators 62*a* so as to face the body containing pockets 32*a* of the body supporters 32. When the elevators 62*a* are raised, the body portions 91 supported by the body containing pockets 32*a* of the body supporters 32 are pushed up by the pins 62*b* to be fitted into the cap portions 92 held by the cap containing pockets 31*a* of the cap supporting circle 31. By raising the elevators 62*a* further more, the cap portions 92 along with the body portions 91 are pressed against the undersurface of the cap depressing plate 61 by the pins 62*b*, so that the cap portions 92 and the body portions 91 are fitted together again to form capsules 90. After the fitting together of the cap portions 92 and the body portions 91, the elevators 62a are brought down.

These capping operations are repeated twice in the positions VIII and IX shown in FIG. 5b, resulting in secure capping and locking of the body portions 91 with the cap portions 92.

Figure 9:
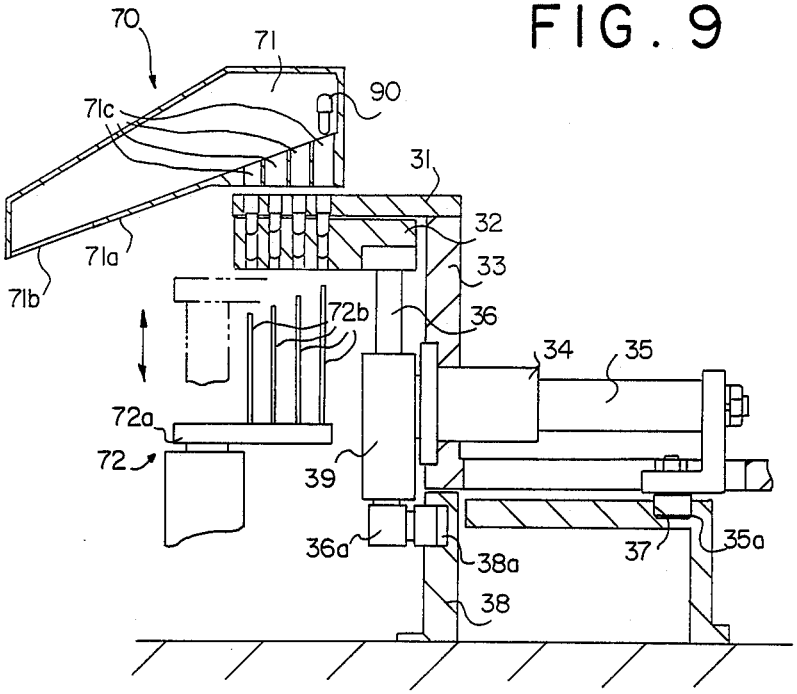
FIG. 9 is a cross sectional view of the ejecting unit of the capsule charging apparatus of the invention.

When the capsules 90 consisting of the cap portions 92 and body portions 91 are moved to the position X shown in FIG. 5b by the rotation of the cap supporting circle 31 and the body supporters 32 by 30°, the capsules 90 are ejected from the cap(as shown in FIG. 9) supporting circle 31 and body supporters 32 by the capsule ejecting unit 70. The capsule ejecting unit 70 comprises a hollow box-shaped chute 71 and a capsule ejector 72. The chute 71 has an inclined bottom, and its upper portion is formed with a plurality of holes 71c which vertically go through the bottom face of the chute 71 to face the group 31b of cap containing pockets 31a of the cap supporting circle 31 while its lower portion is formed with an opening 71b and extends outwardly from the cap supporting circle 31. The lengths of the holes 71a which vertically go through the inclined bottom of the chute 71 are gradually increasing toward the upper end of the inclined bottom of the chute 71.

The capsule ejector 72 has an elevator 72a in the shape of a flat plate which is positioned to face the undersurface of the body supporter 32 and a plurality of pins 72b which protrude from the top surface of the elevator 72a substantially vertically to face the body containing pockets 32a of the body supporter 32. Accordingly, the pins 72b face the holes 71c on the bottom 71a of the chute 71 through the cap containing pockets 31a of the cap supporting circle 31 and the body containing pockets 32a of the body supporter 32 and the lengths of the pins 72b are determined corresponding to the vertical heights of the holes 71c.

When the elevator 72a of the capsule ejector 72 is raised, the pins 72b are inserted into the body containing pockets 32a of the body supporter and push up the capsules 90 consisting of the body portions 91 and the cap portions 92, so that the capsules 90 are extruded by the pins 72b through the holes 71c formed on the bottom 71a of the chute 71 into the chute 71. As mentioned above, the lengths of the pins 72b are such as to correspond to the vertical heights of the holes 71c, so the capsules can be extruded into the chute 71 by the pins 72b without difficulty. The capsules 90 then slip down the inclined bottom 71a of the chute to be ejected outward from the opening 71b on the lower portion of the bottom 71a of the chute 71 into a vessel.

Figure 10:
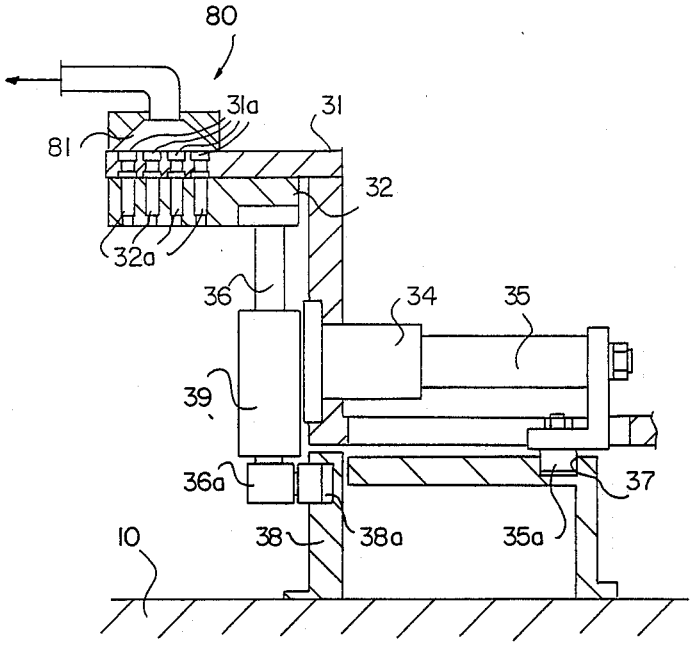
FIG. 10 is a cross sectional view of the cleaning unit of the capsule charging apparatus of the invention.

After the capsules 90 are ejected by the capsule ejecting unit 70 in the position X of FIG. 5b, the cap supporting circle 31 and the body supporters 32 are rotated in the same direction by 30° and the cap containing pockets 31a, and the body containing pockets 32a from which the capsules 90 are ejected are cleaned by a cleaning unit 80 in position XI of FIG. 5b. As shown in FIG. 10, the cleaning unit 80 has a vacuum area 81 which can cover all the cap supporting pockets 31a in the group 31 on the top surface of the cap supporting circle 31 from above. The vacuum area 81 is connected to a proper depressurizing unit. When the air is sucked by the depressurizing unit through the body containing pockets 32a of the body supporter 32, the cap containing pockets 31a, and the vacuum area 81, both the cap containing pockets 31a and the body containing pockets 32a are cleaned.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A capsule charging apparatus including a capsule conveying device housing a driving unit, and a capsule charging device, the capsule conveying device carrying a plurality of capsules each of which has its body portion inserted into its cap portion, in an erected posture with the cap portion on top and the body portion downwards, the capsules being separated into the cap portions and the body portions so that the body portions are charged with a content, wherein:

the capsule conveying device is disposed on a first stand accommodating at least one driving unit;

the capsule charging device is disposed on a second stand;

wherein the first stand comprises first positioning means and the second stand comprises second positioning means, the first means being engageable with the second means so that the capsule charging device is positioned at its working position with respect to the first stand;

wherein the first stand comprises first coupling means and the second stand comprises second coupling means, the first coupling means being engageable with the second coupling means; and a first power transmission line housed in the first coupling means, and a second power transmission line housed in the second coupling means, the first and second transmission lines being connectable to each other, the first and second power transmission lines being connected to the driving unit housed in the first stand.

2. A capsule charging apparatus according to claim 1, wherein said capsule conveying device comprises a capsule moving unit including a cap supporting turret which is intermittently rotated to convey the cap portions separated from the body portions in groups consisting of a fixed number of cap portions and body supporters which respectively convey a fixed number of body portions separated from the cap portions while being intermittently rotated with said cap supporting turret.

3. A capsule charging apparatus according to claim 1, wherein said capsule conveying device comprises capsule arranging unit which supplies said capsule moving unit with a fixed number of capsules in a predetermined arrangement.

4. A capsule charging apparatus according to claim 3, wherein said capsule conveying device comprises a capsule transferring separating unit which separates the capsules arranged by said capsule arranging unit into the cap portions and the body portions while transferring the capsules to said capsule moving unit.

5. A capsule charging apparatus according to claim 1, wherein said charging unit of said capsule charging device charges the body portions of the capsules with a filling of powder, granule, or liquid.

* * * * *